US008314569B2

(12) United States Patent
Adamson et al.

(10) Patent No.: US 8,314,569 B2
(45) Date of Patent: Nov. 20, 2012

(54) LIGHT WAND FOR LIGHTING CONTROL

(75) Inventors: Tony Adamson, Eindhoven (NL); Erik Nieuwlands, Eindhoven (NL); Kumar Arulandu, Eindhoven (NL); Per Ambrosiussen, Eindhoven (NL)

(73) Assignee: Koninklijke Philips Electronic N.V., Eindhoven (NL)

( * ) Notice: Subject to any disclaimer, the term of this patent is extended or adjusted under 35 U.S.C. 154(b) by 505 days.

(21) Appl. No.: 12/513,693

(22) PCT Filed: Nov. 8, 2007

(86) PCT No.: PCT/IB2007/054545

§ 371 (c)(1),
(2), (4) Date: Dec. 30, 2009

(87) PCT Pub. No.: WO2008/059411

PCT Pub. Date: May 22, 2008

(65) Prior Publication Data

US 2010/0090619 A1 Apr. 15, 2010

(30) Foreign Application Priority Data

Nov. 17, 2006 (EP) ..... 06124338

(51) Int. Cl.
*H05B 37/02* (2006.01)

(52) U.S. Cl. ..... 315/291; 315/307; 315/312

(58) Field of Classification Search ..... 315/291, 315/294, 307–308, 312
See application file for complete search history.

(56) References Cited

U.S. PATENT DOCUMENTS

| | | | | |
|---|---|---|---|---|
| 6,037,721 | A * | 3/2000 | Lansing et al. | 315/295 |
| 6,046,550 | A * | 4/2000 | Ference et al. | 315/291 |
| 6,495,973 | B1 * | 12/2002 | Allen, Jr. | 315/302 |
| 2002/0078221 | A1 | 6/2002 | Blackwell et al. | |
| 2003/0057887 | A1 * | 3/2003 | Dowling et al. | 315/291 |
| 2003/0209999 | A1 * | 11/2003 | Hui et al. | 315/294 |
| 2004/0150994 | A1 | 8/2004 | Kazar et al. | |
| 2005/0218838 | A1 * | 10/2005 | Lys | 315/291 |
| 2005/0248299 | A1 * | 11/2005 | Chemel et al. | 315/312 |
| 2005/0275626 | A1 * | 12/2005 | Mueller et al. | 345/156 |
| 2006/0012317 | A1 * | 1/2006 | Chiu et al. | 315/294 |
| 2006/0284734 | A1 * | 12/2006 | Newman, Jr. | 340/825 |

FOREIGN PATENT DOCUMENTS

| | | | |
|---|---|---|---|
| WO | 2005107338 | A2 | 11/2005 |
| WO | 2006048916 | A2 | 5/2006 |
| WO | 2006100650 | A | 9/2006 |
| WO | 2006111927 | A1 | 10/2006 |
| WO | 2006111934 | A1 | 10/2006 |

OTHER PUBLICATIONS

Wilson et al: "XWwand: UI for Intelligent Spaces"; CHI 2003, Apr. 5-10, 2003, vol. 5, Issue 1, pp. 545-552.

Beretta, G.: "Graphical User Interface for Editing a Palette of Colors"; United States Statutory Invention Registration, Reg. No. HI506, Dec. 5, 1995.

* cited by examiner

*Primary Examiner* — Tung X Le
(74) *Attorney, Agent, or Firm* — Mark L. Beloborodov

(57) ABSTRACT

A lighting system (100) includes light sources (110, 115, 120) and a light wand (250) configured to control the light sources in response to user input. The light wand (250) is configured to copy a light attribute of a first light provided from a first light source, and paste the copied light attribute into a second light source so that the second light source provides a second light having the light attribute of the first light.

16 Claims, 9 Drawing Sheets

LIGHT WAND FOR LIGHTING CONTROL

The present invention relates to a remote controller for interacting and controlling light sources including selection, adjustment, copying, dragging and pasting of light attributes among light sources.

Light and lighting have many functions in human life, but traditionally the most prevalent one is basic illumination. Typically, the usual exploitation of lighting includes a set of lamps hardwired by fixed wires to one or more switches to turn the lamps on or off.

However, new exploitation paths in lighting, like beautification and atmosphere creation, continue to arise from improvements in the characteristics of modern light sources which are smaller, require less power, have lower heat output and longer lifetimes, and are controllable to change light attributes such as intensity and/or color temperature of the emitted light.

Small light sources are being used to illuminate a limited space, which can be controlled to operate as a functional light, as a spot light, or for creating a desired atmosphere. For example, the reduced size of solid-state light sources such as light emitting diodes (LEDs), as well as the long lifetimes comparable to lifetimes of furniture, for example, and the low heat outputs thus being safe to touch, allow easy integration into new products, such as furniture, thus enabling new ways of using light and light sources. The increased use of light sources with controllable light attributes (such as color, intensity, directivity, dynamics and the like) and their proliferation in various products, setting and locations, present the need for intuitive and easy control of the light attributes to provide flexible and intelligent light control systems and interfaces.

Further, lighting is used in many environments, where requirements in retail shops present particularly high demands on the level of functionality and control that need to be achieved from a lighting system, often requiring dynamic lighting, color and effects. For example, retail environments use lighting as part of their image and shop design, using lights to create ambiances within the shop, enforce or define a brand, and accent key products in the shop, for example. Consequently, if the shop is part of a wider chain of shops, there is a need to have a commonality across different branches or stores of the chain store to maintain the brand image. In such a scenario, it is preferable to constrain the design of the lighting and have a means of simply replicating colors and effects used in one shop for conformance with the rest of the shops of the chain store.

To assist in common branding across different branches in a chain store having multiple shops at multiple locations, lighting effects may be setup to create the same look and feel no matter which store is visited. The problem in achieving this is caused by the large number of colors available and a potentially large number of lights in the shop. Traditional forms of lighting control systems have involved either a slider interface or even text file entry and uploading, both of which may be very laborious and non-intuitive for untrained staff.

Furthermore, the capabilities of different stores may substantially differ in terms of the lighting setup. Smaller stores in a chain would probably have a significantly smaller setup or lighting system and less trained personnel or expertise, where the system in the shop needs to be tailored into any form of "roll out" of lighting settings. A trivial roll out of light settings with addresses is likely to be ineffective to properly provide the desired lighting, and would likely result in a poor match with other shops.

A further issue with conventional lighting systems and means for rolling out colors to provide a specific lighting ambiance, or a specific look and feel, is that the rendering of the particular color is likely dependent on the characteristics of the medium where the color is being observed or viewed. For example, if a color is viewed on two separate screens, or on printed paper, the color will be dependent on the brightness, contrast and color saturation of the screen, and ink quality of the printer. To accurately recreate a color in two locations is therefore difficult. The mechanism in which commonality could be achieved therefore requires an appropriate level of human input and expertise as well as the right interaction tools to allow the designer to achieve a consistent ambiance easily.

Accordingly, there is a need to provide a simple and intuitive lighting control and interface, such as adjusting the lighting within a shop or retail environment and reproducible a desired color with ease, as typically clerks and staff, as well as the typical consumers using sophisticated lighting systems in the home environment or elsewhere, are not trained in lighting design or control software, for example.

One object of the present systems and methods is to overcome the disadvantage of conventional lighting control, design and interactive systems, where human-light interaction systems, devices and methods are provided to assist in the design and control of light systems, as well as to provide a responsive and intuitive interaction systems, devices and methods for controlling light sources using a hand held pointing device, for example.

This and other objects are achieved by systems, devices and methods comprising light sources and a light wand configured to control the light sources in response to user input. The light wand is configured to copy a light attribute of a first light provided from a first light source, and paste the copied light attribute into a second light source so that the second light source provides a second light having the light attribute of the first light. Illustratively, the light wand has a key that copies the light attribute when activated while pointing to the first light source, drags the attribute to the second light source by moving the light want towards the second light source e.g., while the key is held down, and pastes the light attribute to the second light source upon deactivating the key.

Further areas of applicability of the present systems, devices and methods will become apparent from the detailed description provided hereinafter. It should be understood that the detailed description and specific examples, while indicating exemplary embodiments of the systems, devices and methods, are intended for purposes of illustration only and are not intended to limit the scope of the invention.

These and other features, aspects, and advantages of the apparatus, systems and methods of the present invention will become better understood from the following description, appended claims, and accompanying drawing where:

Figure 1:
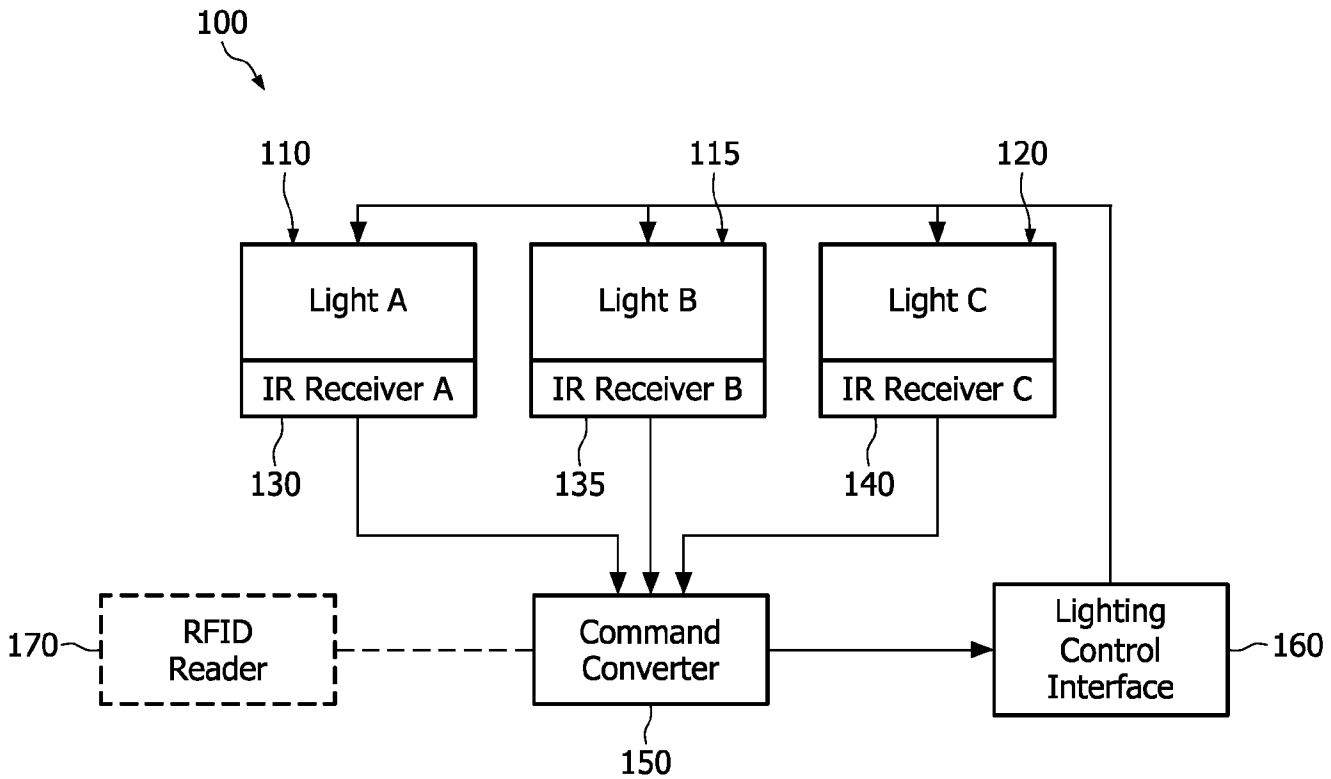
FIG. 1 shows a block diagram according to one embodiment of the present system.

The following description of certain exemplary embodiment(s) is merely exemplary in nature and is in no way intended to limit the invention, its application, or uses. In the following detailed description of embodiments of the present systems and methods, reference is made to the accompanying drawings which form a part hereof, and in which are shown by way of illustration specific embodiments in which the described systems and methods may be practiced. These embodiments are described in sufficient detail to enable those skilled in the art to practice the presently disclosed systems and methods, and it is to be understood that other embodiments may be utilized and that structural and logical changes may be made without departing from the spirit and scope of the present system.

The following detailed description is therefore not to be taken in a limiting sense, and the scope of the present system is defined only by the appended claims. The leading digit(s) of the reference numbers in the figures herein typically correspond to the figure number, with the exception that identical components which appear in multiple figures are identified by the same reference numbers. Moreover, for the purpose of clarity, detailed descriptions of well-known devices, circuits, and methods are omitted so as not to obscure the description of the present system.

Typical lighting control systems including many colored light sources suffer from inherent complexities involved in setting up and controlling the colored lighting. Often store or shop workers do not have sufficient experience working with complicated light systems. Historically, the customization of lighting systems has been through laborious text entry, software modification, and/or similarly complex and non-intuitive methods.

One particular problem is relating to addressing particular lights to adjust their colors. This often requires lookup on a chart to ensure the correct light sources are selected when adjusting the color of light, for example. The present systems, devices and methods provide a much faster and more user-friendly means for setting up and changing the lighting of an environment. For example, the present systems, devices and methods provide means for an unskilled person to be able to change a set of lights using a wireless pointing device. Light sources are mounted in the back panels of compartments within a cabinet, for example, in a shop display cabinet, typically covered with a diffuser to provide an even luminance across the whole panel. The light sources may have full RGB color capability and the ability to be dimmed up and dimmed down, for example.

The light sources may be any controllable light sources capable of providing lights of various attributes, such as various intensity levels, different colors, hue, saturation and the like, including any one of or combination(s) of LEDs, incandescent, fluorescent, halogen, or high intensity discharge (HID) light, which may have a ballast for control of the various light attributes. However, LEDs are particularly well suited light sources as they can be easily configured to provide light with changing light attributes (such as changing colors, intensity, hue, saturation and other attributes), and typically have electronic drive circuitry for control and adjustment of the various light attributes. Of course, the LEDs may include individually controllable red, green and blue LEDs that in combination provide any desired color including white light, intensity and the like.

As will be described in further detail, a handheld device may be used to point at a particular compartment and change the attributes, e.g., color, brightness, hue, saturation, and/or directivity, of the light sources inside that compartment to adjust the light emanating from the light sources. The handheld device also allows a user to "drag" a compartment's color to another panel. "Dragging" is achieved, for example, by the user pressing and holding a button on the handheld device, and pointing to a new compartment where, for example, the "dragged" light will then follow where the device is pointing and then will remain on the panel that is pointed at (to illuminate the pointed panel with a light having attributes of the dragged light) when the user releases the held-down "drag" button, for example. An undo button or option may also be included to allow the user to reverse the last action if so desired. Thus, the present systems, devices and methods provide the user a way of quickly addressing a light source by pointing at it and recreating light attributes, such as colors, very quickly without the need for a separate and complicated user interface (UI).

FIG. 1 shows an overview of the system architecture 100 according to one embodiment of the present system having a plurality of light sources, where illustratively three light sources 110, 115, 120 are shown each having a transceiver 130, 135, 140 which may be operated in any frequency range, such as infrared (IR), sonar, laser, or another radio frequency (RF). Of course, it should be understood that there is no limit on the number of light sources and/or panels that may be used. Each light source may also have its own controller, such as a ballast or an electronic controller that controls the respective light sources, such as turning them ON/OFF or changing attributes of light emanating therefrom.

Figure 2:
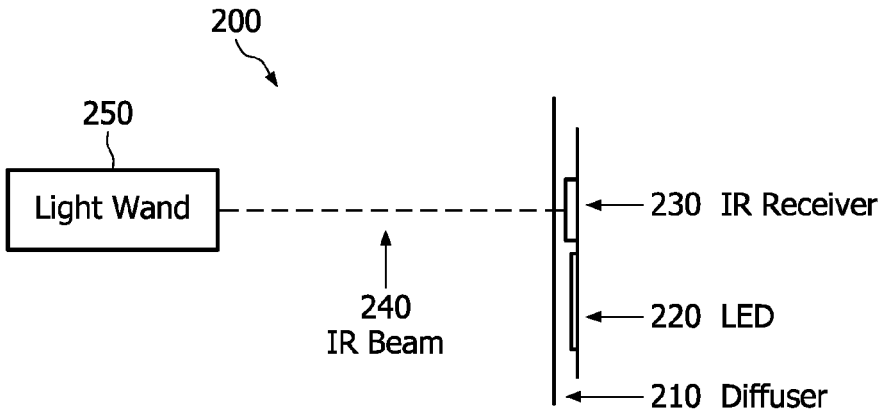
FIG. 2 shows an illustrative physical arrangement of light sources and IR receivers according to another illustrative embodiment of the present system.

In the illustrative setting of a shop or store, the set of lights 110, 115, 120 may be mounted on the rear wall of separate compartments or panels of shop furniture, for example, in shelves or cabinets. To provide an even luminance across an entire panel, each panel may include many light sources that are spread across the panel where a diffuser 210, shown in FIG. 2, may be mounted in front of the light sources, where one light source 220 is shown in FIG. 2, to blend the light emitted by each light source and ensure an even illumination, such as an even color for example. FIG. 2 shows an illustrative physical arrangement 200 of one light source 220 of the light source(s) 110, 115, 120 and one IR receiver 230 of the IR receivers 130, 135, 140 shown in FIG. 1.

Figure 3:
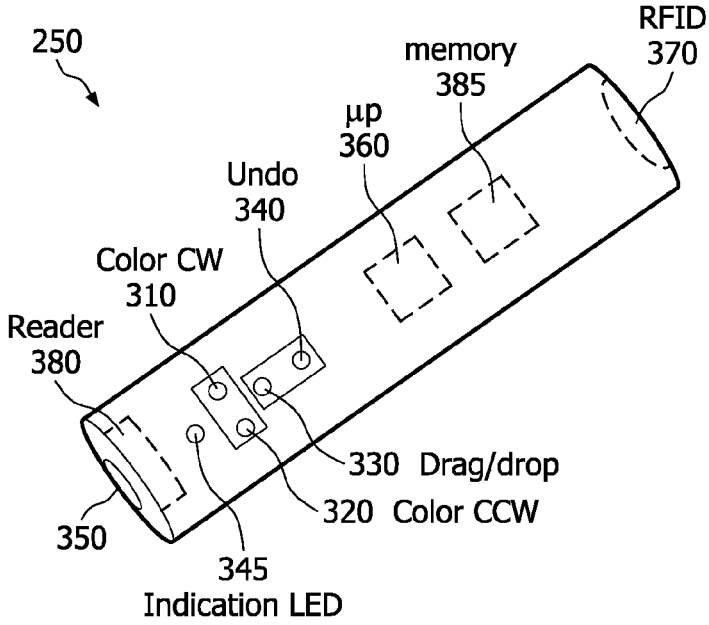
FIG. 3 shows a controller with a user interface according to a further illustrative embodiment of the present system.

The transceivers 130, 135, 140 including for example IR receivers (where one IR receiver 230 is shown in FIG. 2) may be each located in a separate compartment, behind the diffuser 210 and out of sight, and are able to receive an IR signal 240 (FIG. 2) transmitted from a hand-held remote controller, also referred to as a light wand or laser pen 250 shown in FIGS. 2-3, for example. The light wand 250 is battery-operated, pen-shaped device with four buttons for example, including "drag", "color left", "color right" and "undo" buttons. The light wand emits 250 a focused IR beam for example from an end that is pointed towards the light sources 110, 115, 120.

A command converter 150, shown in FIG. 1, is operationally connected or coupled to the IR receivers via any link, wired or wireless, such as via an IR or RF link, to receive messages from the transceivers 130, 135, 140. The command converter 150 may be configured to include a lighting system controller 160 (that may have a user interface as desired)

which is operationally coupled to the transceivers 130, 135, 140 via any type of link, wired or wireless, such as via IR or RF for example (e.g., using Bluetooth™ or Zigbee™ protocols), to provide or transmit control signals to the transceivers 130, 135, 140 for controlling the light sources 110, 115, 120. Illustratively, the IR receivers/transceivers 130, 135, 140 are connected to the command converter 150 via a serial connection (e.g. RS232), which in turn is connected to the system controller 160 that controls the light sources 110, 115, 120. Any protocol may be used for various communication links, such as DMX or DALI, or a proprietary protocols and/or algorithms, for example.

Each light, panel, group of lights, and/or group of panels may have its own unique identification (ID), used for addressing and control, for example, such as included in an RFID tag or any other hardware, software, or signal. The identification may be communicated to the light wand 250, e.g., to a pen controller 360 such as a microprocessor (μp) of the light wand 250, by any means wired or wireless such as via RF, laser and/or infrared signals for example.

As shown in FIG. 3, the light wand or pen 250 is a unit held by the user and comprises four buttons 310, 320, 330, 340 and focused IR and/or laser beam source(s) 350 to communicate with the IR receivers 130, 135, 140 in the system 100 shown in FIG. 1, and/or provide visual feedback to the user. For feedback, the pen 250 may also contains one or more LEDs 345. Of course, if desired, a visible laser beam may also be included along with the IR beam to illuminate the area being pointed to and thus provide visual feedback to the user as to where the pen 250 is pointed. The laser beam may also be used alone without further beams, and may also include control information that may be received by an appropriate receiver or detector at the light source/panel being pointed to for further processing.

The four buttons shown in FIG. 3 include clockwise (CW) and counter-clockwise (CCW) color buttons 310, 320, a drag/drop button 330 and an undo button 340. Of course, these buttons may also provide further functions, and/or the light wand or pen 250 may have additional buttons programmable and/or pre-configured to provide further functions. The beam (240 of FIG. 2) emanating from the IR beam source 350 may be focused to allow directional control and for the IR beam to be received by IR receiver at a time. Illustratively, the pen 250 contains a controller or microprocessor 360 that generates RC5 commands, for example, when the buttons are pressed. The actual protocol may be modified from the standard RC5 commands as needed, such as to also allow a button up or button release message to be sent when the drag/drop button 330 is released after being held down during the dragging operation.

When any button of the various buttons 310-340 of the laser pen 250 or of any other user interface is activated, RC5 commands may be transmitted in the following way shown in Table 1, for example:

TABLE 1

Behavior of the buttons on the laser pen

| Condition | Action |
|---|---|
| <Key> pressed and held | Sends an IR message "<Key>_Down". After a period of milliseconds, this is followed by a series of repeating "<Key>_Down_Repeated" messages. |
| <Key> released | Sends an IR message "<Key>_Up". This will discontinue any IR messages being sent from the key being pressed down and held. |

Any protocol, standard or proprietary protocol may be used, with modifications if needed. For example, a standard RC5 command does not respond to "Button Up" commands and so such an additional command may be added.

Figure 4:
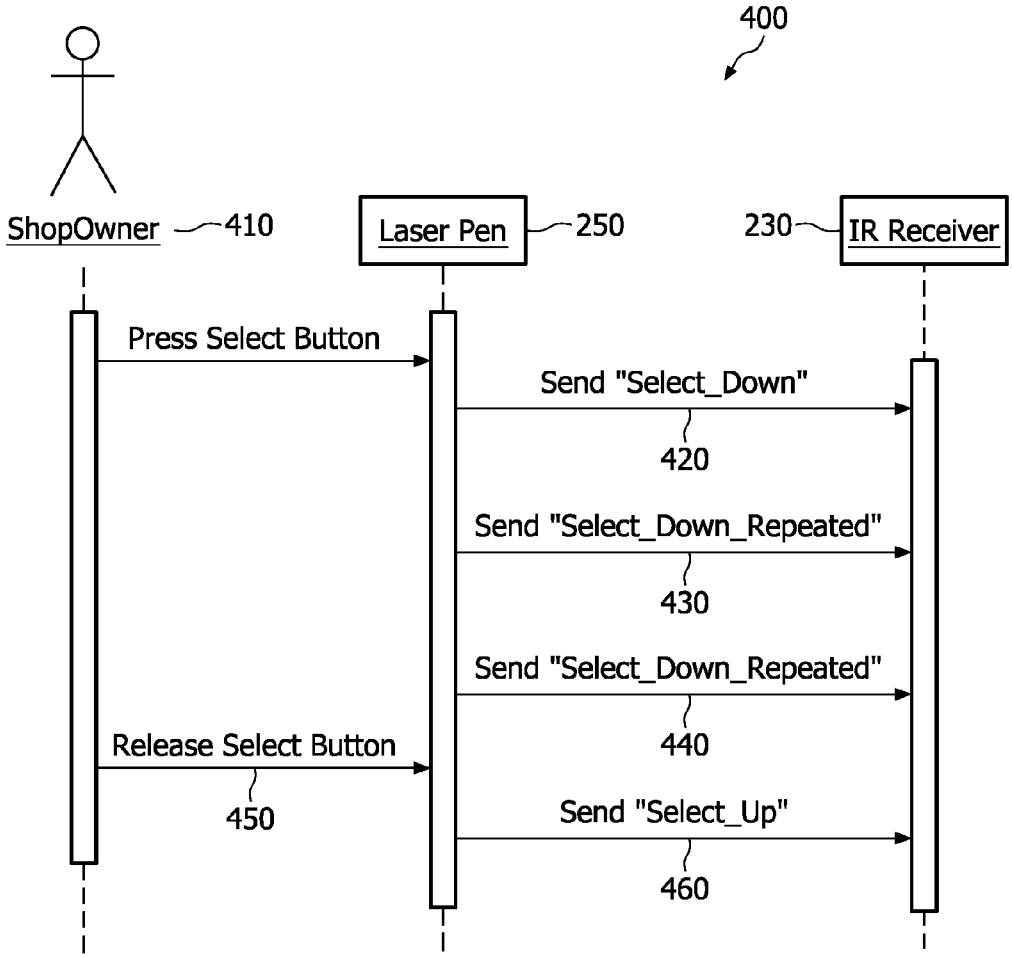
FIG. 4 shows a sequence diagram for user interaction with a controller/user interface according to another illustrative embodiment of the present system.

FIG. 4 shows an illustrative sequence diagram 400 of interactions between a user 410 (e.g., a shop owner) and the light wand/pen 250, sending commands to the IR Receiver(s) 230 (also shown in FIG. 2, and shown in FIG. 1 as reference numerals 130, 135, 140). As an example, the sequence for one button referred to as a "Select" button is shown, although all other buttons may exhibit the same or similar behavior. For clarity, only one IR Receiver 230 is shown in FIG. 1 as the recipient of the messages but any number of receivers (including zero) may receive the messages or be addressed. Of course, any one receiver or group(s) of receivers may be specifically or collectively addressed by signals broadcast to all the receivers, for example, where unique addresses of the desired receiver(s) or group(s) of receivers may be included in the signal, e.g., upon selection by the user of the receiver(s)/group(s) to be addressed, such as by merely pointing to the desired receiver. That is, alternatively or in addition, the pen 250 may transmit a narrow beam signal pointed to and/or focused on one or more receivers to be communicated with or controlled. Illustratively, when the "Select" button is the drag/drop button 320, then a Key_Down copies light attributes of light emanating from the light source pointed to by the light wand/pen 250. As explained in further detail in connection with FIGS. 9A-9D, the copied light attributes may be dragged though various light sources/panels as the light pen 250 is moved e.g., while pointing sequentially to the various light sources/panels, and the copied light attributes are pasted to one of the light source being pointed by the light pen 250 when the held-down drag/drop button 320 is released.

As described in connection with Table 1 and shown in FIG. 4, when a one of the button (e.g., select button) of the light pen 250 is pressed by a user 410, as indicated by arrow 415, the light pen 250 transmits a Select_Down command 420 to the IR receiver 230, which is repeated as shown by reference numerals 430, 440, until the user 410 releases the pressed select button. In response to the button release action 450 of the user 410, the light pen 250 transmits a Select_Up command 460 to the receiver 230.

The IR receivers 230 may be mounted behind luminance panels of cabinets in a room or retail shop, for example. The receivers 230 may include or be operationally coupled to converters (150 in FIG. 1) as necessary to extract and transform desired information to usable formats, such as the converter 150 shown in FIG. 1, to convert the received IR signals to RS232 signals, for example. Thus, the receivers 230 (also shown as reference numeral 130, 135, 140 in FIG. 1) may be configured to receive IR messages from the light pen 250 and transmit RS232 messages to the command converter 150 shown in FIG. 1. Upon reception of an IR message from the light pen 250, for example, the IR receiver processes the received IR message according to the state machine 500 shown in FIG. 5.

Figure 5:
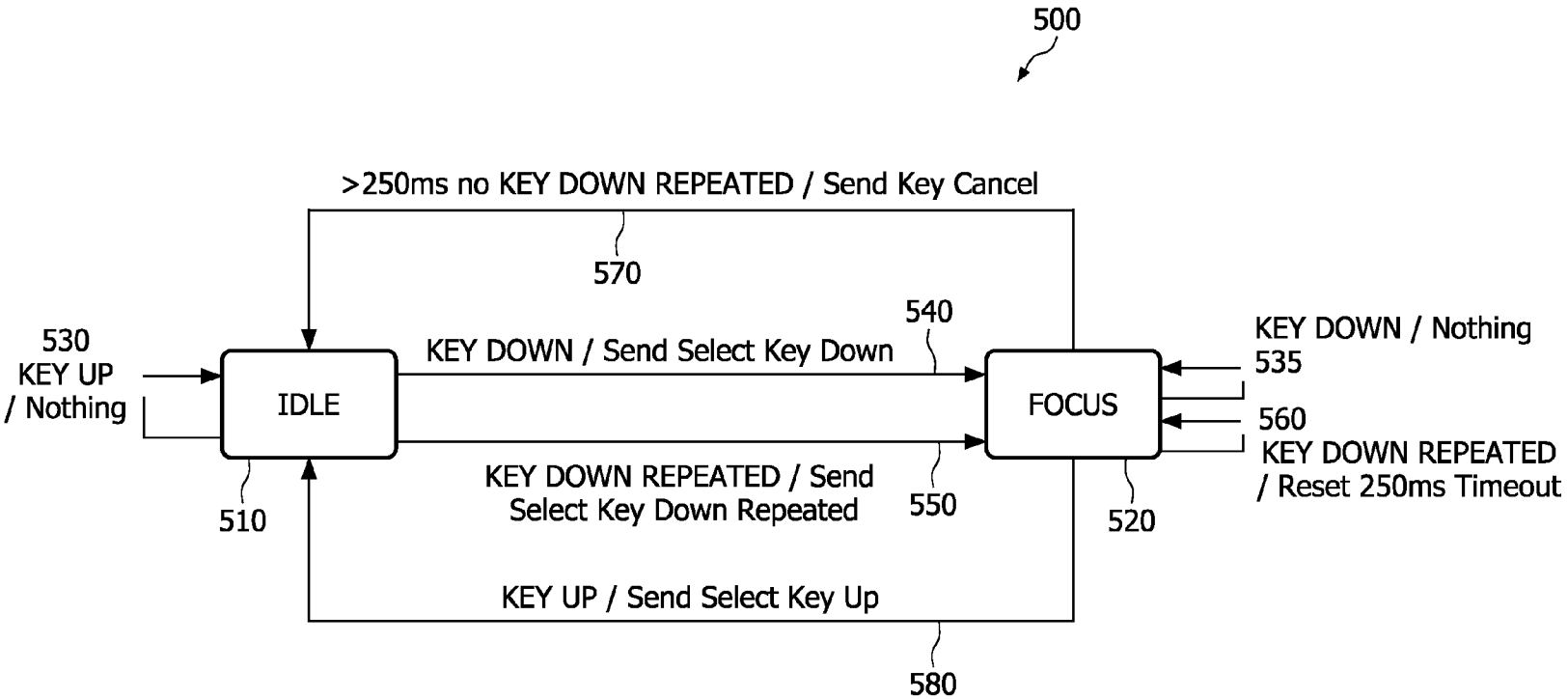
FIG. 5 shows an internal state machine of IR receivers according to yet another illustrative embodiment of the present system.
Figure 6:
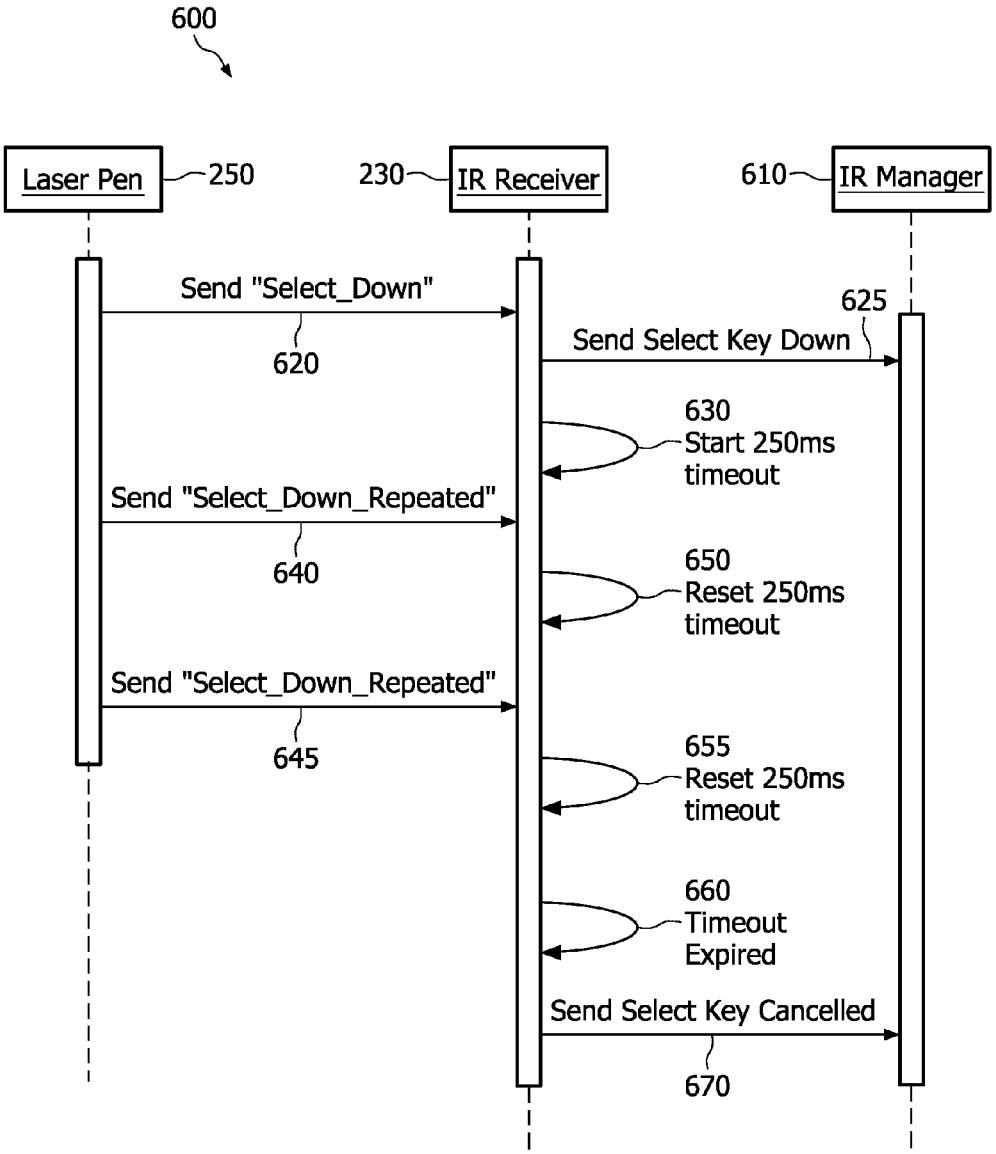
FIGS. 6-7 show illustrative sequence diagrams showing various routes through a state machine according to a further embodiment of the present system.
Figure 7:
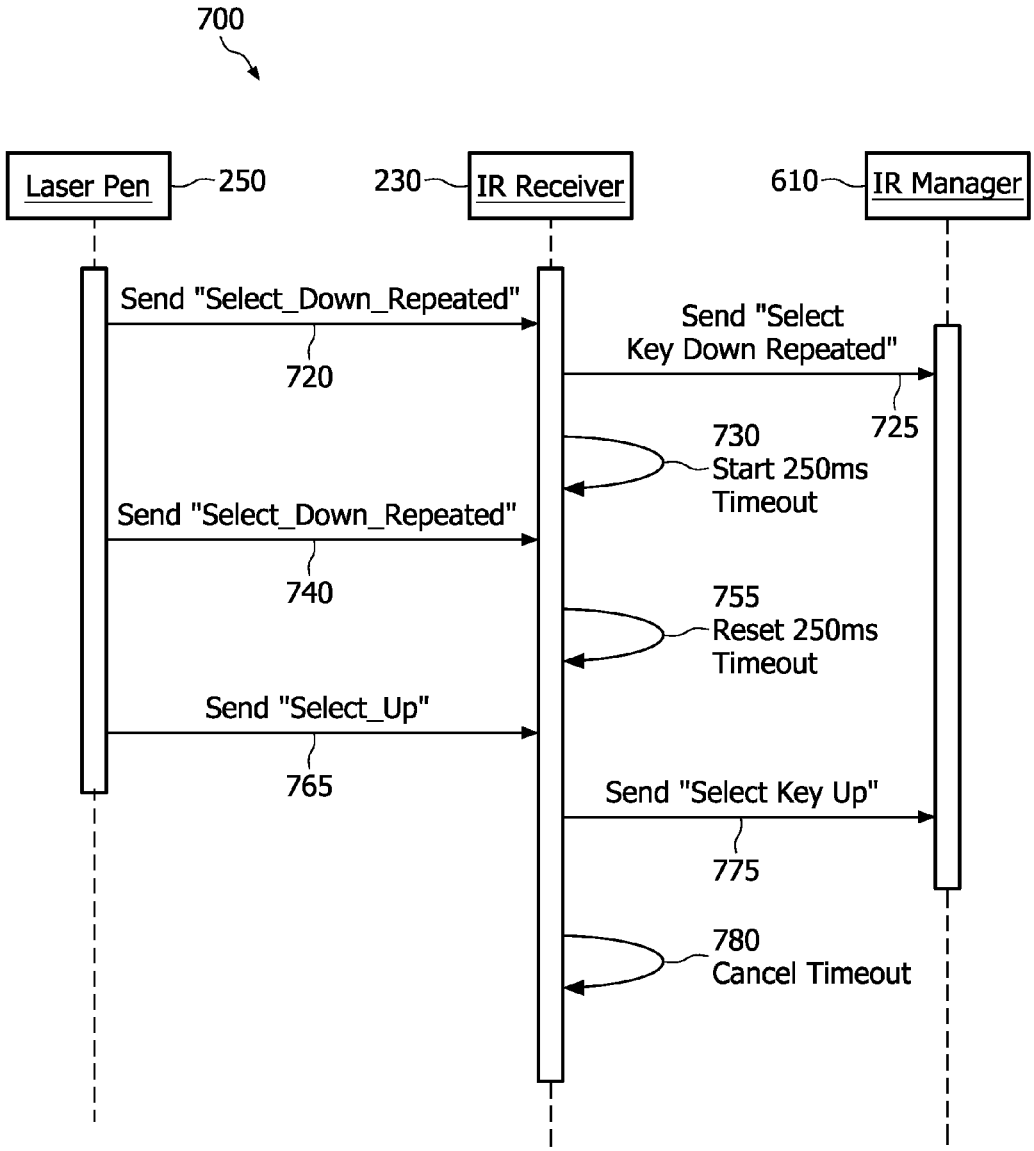

As shown in FIG. 5, the state machine 500 includes an idle state 510 and a focus or active state 520. An idle state of the light pen, e.g., Key_Up, is represented by arrows 530, 535. FIGS. 6-7 also show in greater detail sequence diagrams 600, 700 showing various routes (through the state machine) among the laser pen 250, one of the receivers 230, and a manager 610 operationally coupled to, or integrated with, the receiver 230. In particular, FIG. 6 shows a sequence diagram 600 for a button being pressed and thus copying light attributes associated with the light source being pointed to, while FIG. 7 shown a sequence diagram 700 for dragging the copied light attributes while holding the (copy) button and moving the pen to point to another light source(s), and then releasing the (copy) button thus pasting the copied light attributes to the new light source(s) or panel(s) currently pointed to.

As shown in FIGS. 5-7, when a key Key_Down signal or command 610 is received by the receiver 230, then a Key_Down path 540 is followed to go from the idle state 510 to the active state 520, as shown in FIG. 5, and a Key_Down signal 625 is sent from the receiver 230 to the manager 610, and a timeout timer is started as shown by reference numeral 630 in FIG. 6. The timeout timer may be implemented by hardware or software and may count to any programmable count, as desired.

Further, when the key is held down continuously then a Key-Down_Repeated signals 640, 645 are transmitted from the light pen 250. When the Key-Down_Repeated signals 640, 645 are received within a predetermined time, such as within 250 ms (t≦250 ms), then the state of the receiver follows a Key_Down_Repeated path 550 to change from the idle state 510 to the active state 520, as shown in FIG. 5. Further, Reset_Timeout signals 650, 655 (FIG. 6) reset a 250 ms timer, for example, and a Reset_Timeout path 560 keeps the receiver in the active state 520 and resets the 250 ms timeout timer, for example.

If a Key-Down_Repeated command is not received within a certain time, e.g., not received for more than 250 ms, then a Key_Cancel path 570 brings the state back to the idle state 510 (from the active state 520), and the timer expires generating a timer expired signal 660 and triggering transmission of a Key-Cancel signal 670, as shown in FIG. 6.

As shown in FIG. 7, when a Key-Down_Repeated command 720 is received, the receiver 230 informs the manager 610 via signal 725, and the timeout timer is started by signal 730. Further a Key-Down_Repeated command(s) 720 generates further timeout reset signal(s) 755. When a Key-Up command 765 s received from the light pen 250, then the receiver 230 informs the manager 610 via signal 775, generates a cancel timeout signal 780 to cancel any counting of the timeout timer, and path Key_Up 580 is followed to go from the active state 520 to the idle state 510, as shown in FIG. 5.

Software associates with the command converter 150 shown in FIG. 1, for example, interprets the different messages coming from the IR receivers to determine the state of the system and which lights to adjust. Due to the nature of IR and the proximity of the IR receivers to one another, the management of messages may take into account some level of filtering to ensure that only relevant messages are processed. For example, when the light wand or pen 250 is dragging a light across two panels, responding to all the commands may cause some flickering as a consequence of both panels receiving the "Select Key Down Repeated" message.

To overcome or prevent any flickering, the command converter 150 may be configured to use an internal queue. All messages received from the IR Receivers are placed into the queue, where the message at the front of the queue represents the state, which is maintained. The state may be updated if it becomes invalid. An example of this would be when panel X is selected and then a key cancelled command is received. This invalidates the current state, so it is removed from the queue and the next message behind it becomes the new state. Likewise, if any Key_Cancel or Key_Up commands are received relating to messages further up in the queue, these are also removed. Furthermore, duplicate messages or those that are not relevant for that state are ignored or added to the queue to be dealt with should they later become relevant. Messages may be removed from the queue if, for example, key cancelled commands are received, thus invalidating them.

At all times, it is the message at the head of the queue that is acted upon. Table 2 gives illustrative examples of how the different messages are responded to:

TABLE 2

| Select Scroll Key Parameter | Action |
|---|---|
| Key Down from panel X | Abort current drag and drop and restart another on panel X |
| Key Down Repeated from panel X | Move the drag light to panel X |

Key_Up and Cancelled commands, upon receipt are handled as shown in Table 3, for example:

TABLE 3

| Select Scroll Key Parameter | Action |
|---|---|
| Key Up from panel X | Clear queue and end drag on panel X |
| Key Cancelled from panel X | If panel X is the current dragged panel, then pop another message from the queue and move the drag to the new compartment |

Further, Table 4 shows three other illustrative commands which perform the following actions shown in Table 4:

TABLE 4

| Command Received | Action |
|---|---|
| Begin drag and drop on panel X | Flash start panel X, set it as "current dragged panel" and store its settings as "drag color" |
| Move drag to panel X | Restore the previous settings of "current dragged panel" and set panel X as "current dragged panel". Change panel X to "drag color" |
| End drag and drop on panel X | Flash panel X and permanently update panel X with "drag color" |

The pen controller 360 of the light wand/pen 250 may also be configured to allow the light pen 250 to cycle through various light attributes, such as colors, brightness, saturation and the like and to adjust or change any of the selected light attributes. Table 5 shows various illustrative interactions and control of light sources and attributes of light emanating therefrom, as follows:

TABLE 5

| Color Adjust Key Parameter | Action |
|---|---|
| Key Down | Abort current color cycle and restart another |
| Key Down Repeated | No action |
| Key Up | Inform pen controller to end color cycle |
| Key Cancelled Inform | Inform pen controller to end color cycle |

Figure 8:
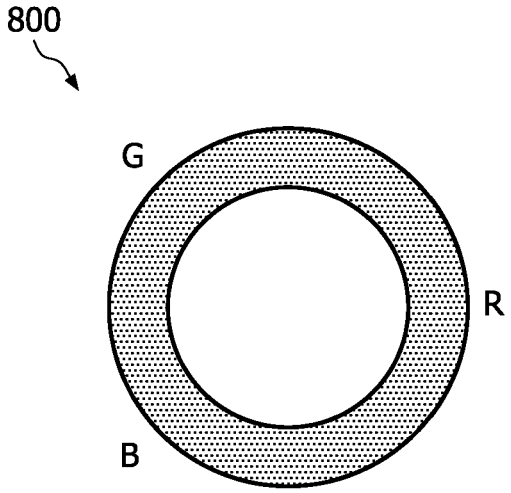
FIG. 8 shows a color circle for changing the color of light according to another illustrative embodiment of the present system.

When a color key 310, 320 of the light pen 250 shown in FIG. 3 is held down, the color cycle periodically changes and updates the color of the light in the appropriate panel or compartment pointed to by the light pen 250, moving around a color circle 800 shown in FIG. 8 that include colors from red, to green to blue and intermediate colors, for example. The color change or update of the light emanating from the light source(s) being controlled (and illuminating a panel or compartment, for example) stops when the user releases the held-down button, thus selecting the last color. The direction around the color circle is dependent upon which of the color buttons 310, 320 is pressed and moves clockwise (CW) or counter-clockwise (CCW). Brightness and saturation adjustments may be also performed by pressing other light pen buttons, or the same color buttons 310, 320 upon changing the button mode from color, to brightness and to saturation, for example, via a further mode selection button. Similar to color adjustment, brightness and saturation may be incremented or decremented until either the user releases the appropriate held-down button or when a maximum/minimum is reached, at which point no further adjustment occurs, for example.

FIGS. 9A-9D show a set of panels 900 that are independently illuminated and controlled to provide an illustrative scenario using the light pen 250 to give an illustrative overview of operation of the present system, for example. The set 900 includes a first panel 910 which is illuminated with red light R, a second panel 920 illuminated with green light G, a third panel 930 illuminated with orange light O, a fourth panel 940 illuminated with yellow light Y, a fifth panel 950 illuminated with blue light B, and a sixth panel 960 illuminated with white light W, for example.

Figure 9A:
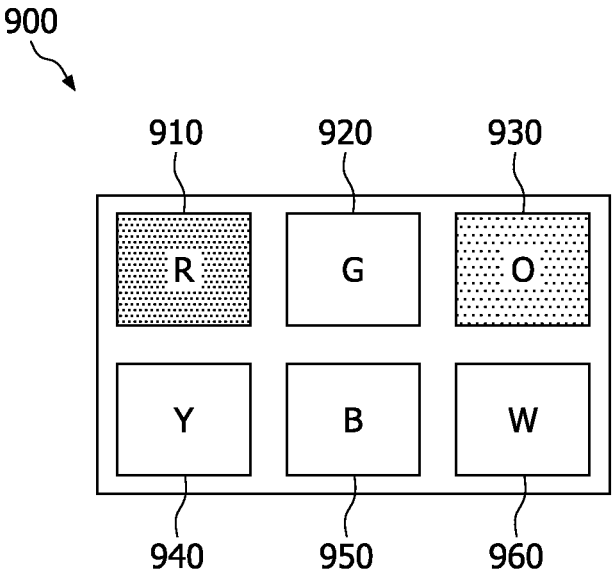
FIGS. 9A-9D show a set of panels that are independently illuminated and controlled according to yet another illustrative embodiment of the present system.
Figure 9B:
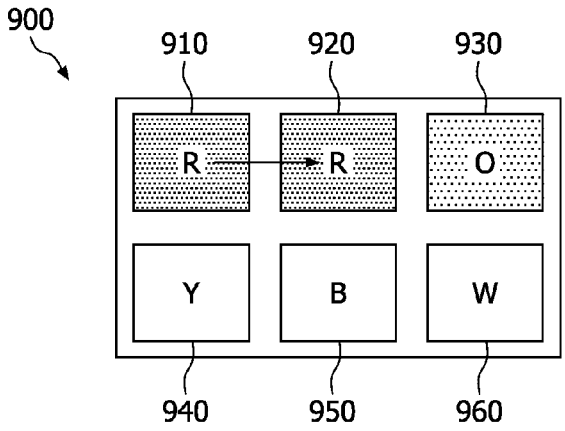

To copy the red R color from the first panel 910 to the sixth panel 960, the user may point the light wand 250 at panel 910 and press and holds a Select button, which may be the drag/drop button 330 shown in FIG. 3. The first panel 910 may be configured to flash, indicating that it has been selected. The user then may move the light wand 250 to point at the second panel 920 where its color updates or changes to the dragged color, namely, red R as shown in FIG. 9B.

Figure 9C:
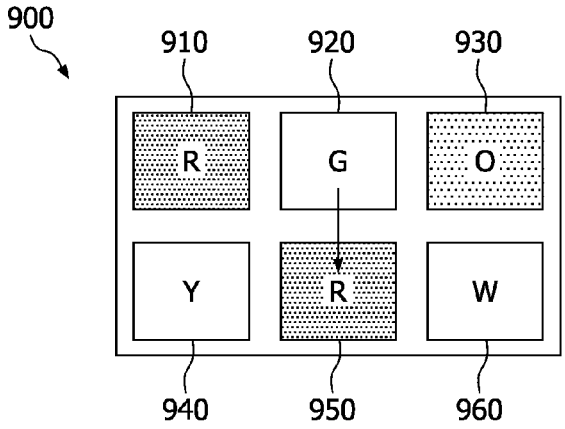

Next, as shown in FIG. 9C, the user may point the light wand 250 or move it down to the fifth panel 950 while the Select button is held-down. Now the color of light illuminating the fifth panel 950 changes from blue B to the dragged color, namely red R. As shown in FIG. 9C, when the light wand 350 is pointed or dragged to the fifth panel 950 from the second panel 920, then the color of the second panel 920 reverts back to its original color, i.e., changes back to Green G from red R.

Figure 9D:
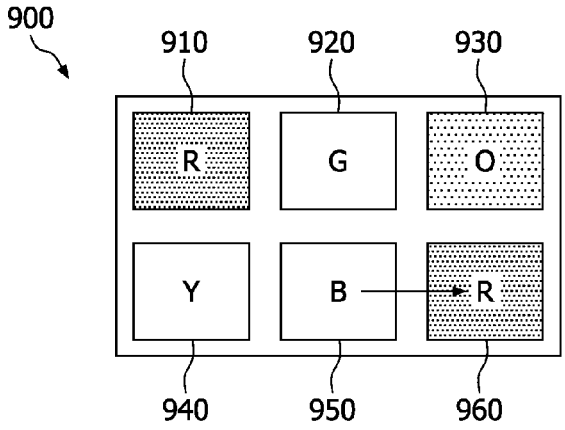

Next, as shown in FIG. 9D, the user may move the light pen 250 to point it at the sixth panel 960 and release the Select button. This causes the sixth panel 960 to change its original white color to the red R color of the first panel 910, where the sixth panel 960 may be configured flash once the button is released, for example, indicating completion of the copy and paste operations, and the color of the sixth panel 960 remain red R. That is, the color red R has been copied from the first panel 910 and pasted to the sixth panel 960.

Once the color red R has been copied from the first to the sixth panel, for example, the user may then fine tune the color settings using the pen's color or brightness adjust buttons while pointing at any of the panels to achieve the desired color or other desired light attributes. Of course, adjustment of light attributes may be performed anytime, not just upon completion of the copy and paste operations, simply by pointing to a desired light source or panel, selecting the attribute to be changed and changing it by one or a combination of light pen buttons, to select an attribute like color or intensity, and then changing the selected attribute of light illuminating the selected panel, e.g., selected by pointing the light pen 350 at the panel and/or activating a select key, for example.

In addition to the described systems, where various light sources and/or panels are located closely, such as in one room or area, further lighting systems may potentially include a large number of light sources and/or illuminable panels over different areas, rooms, or floors within a building or external locations. For such large lighting systems controlling lights over large and/or different areas, it is desirable to allow multiple users to operate the lighting system simultaneously so that changes to the lighting at various locations can be made simultaneously and quickly, without affecting the lighting in other locations of the lighting system using several pointing devices configured for communication with the lighting controller, e.g., via IR, RF, laser or any other wireless or wired communication means, such as via the light wands/pens 250.

Similar to the previous embodiments, the light wand/pen 250 may use a focused infrared beam to identify individual lights and adjust their settings (e.g., color, luminance, saturation, etc.), copy their settings to other lights or undo the last action. For example, the undo button 340 may be activated to undo the last command, or to undo the last several commands by continuously pressing the undo button, e.g., to revert to the previous paste action(s). If desired, unique identification of each light source/panel or groups of light sources/panels may be dispensed with to reduce cost, and the light pen(s) 250 may control any desired light/panel by pointing to the desired light/panel and activating pen buttons.

Of course, if desired, the system may be configure to allow only a single user at any one time control the lights, such as by having only a single light pen capable of the various light controls. However, such a limitation may be onerous particularly for systems controlling large lighting environments that include many rooms or building floors. In such a large environment, the lighting system may likely be part of a wider building management system. For such a large scale building, it would be impractical to allow only one individual to use a light wand/pen 250 or limit use of the light pen 250 to sequential use as opposed to simultaneous or parallel use where more than one light pen 250 may be used simultaneously by one or different users. One possible solution would be to introduce multiple systems but this may be problematic where conflicts may arise as well as expensive if the lighting control system is connected to a large building management system, for example.

Instead, the system (e.g., system controller 160 of FIG. 1) may be configured to accept commands and be controlled from more than one light pen simultaneously, where for example, a first light pen may be used to control lights in a first room (or a first light source/panel) and simultaneously a second light pen may be used to control lights in a second room (or a second light source/panel). The system controller 160 may be configured to determine that different users and/or different light pens are attempting to control the lighting system, and assign the users or the different light pens distinguishing identifications, so that the system knows that a first command is transmitted from a first pen to control a first light source, while a second command is transmitted by a second pen to control a second light source, for example. Thus, the system controller 160 may be configured such that the first command does not affect the second light source, and the second command does not affect the first light source, for example. Further, the system controller 160 may be configured to couple the first light pen with a first room, and the second light pen with the second room, for example, upon detection (e.g., upon first use or registration) of a particular light pen in a particular room or area.

Accordingly, multiple users are able to change setting of lights using different light wands simultaneously, or multiple light wands may be used to simultaneously control multiple light sources. The light wand may be used to point at a particular light source positioned in certain parts of an area and to control that light source, such as change the color or brightness and, as described, to copy and paste light attributes from one light source to another by dragging and releasing the light attribute from one light source to another using the drag/drop button 330 on the light wand 250 shown in FIG. 3, namely, by pressing the button while the light wand 250 is pointed at a source, holding and dragging the light attributes, and releasing the button 330 at the destination.

In order to distinguish among the different light wands and identify a particular light wand, addressing information may be included in the IR commands transmitted by the particular light wand to the IR receivers. For example, an RFID tag 370 may be included in the base of the light wands, as shown in FIG. 3, to store addressing or identification information unique to each light wand. The RFID tag 370 may be operationally couple to the pen controller 360 via a General Purpose Input/Output (GPIO) lines, for example.

Furthermore as shown in FIG. 1 by the dotted box, an RFID tag reader 170 may be operationally coupled to, or included in, the command converter 150 and/or the system control 160 to read the received RFID addresses as well as to configure, such as assign unique IDs (or change them as desired) to the RFID tags of the light wands/pens 250. Thus, in addition to transmitting control (e.g., IR) signals, the light wands/pens 250 may additionally transmit RFID information. As described, the RFID tag may be a programmable RFID tag for uploading information onto the light wand, e.g., from the system controller 160. Alternatively or in addition, the system controller 160 may be manually programmable by the user, for example, to include the unique identification codes of the various light pens.

The RFID tag reader 170 and system controller 160 may be configured to read and write information to RFID tags connected to the light wands/pens 250, as well as to the command converter 150 (and/or system controller 160) in the case where the unique RFID information is also assigned to the light sources 110, 115, 120 for individual identification and control thereof. In this case, in addition to the sending of "Button up" messages, the protocol may be further modified from the standard RC5 commands to include an additional address field, such an 8-bit address field which is appended to the message to uniquely identify the address of the sending light wand, for example. The address of the particular light wand is stored on the RFID tag 370 and is read for use in IR transmissions, for example. Thus, the commands from the light pen 250 shown in FIGS. 4-7 may also include the unique ID of the light pen 250, where the unique pen ID is also passed from the IR receiver 230 to the IR manager 610 shown in FIGS. 6-7.

In order to identify the light wand 250, the RFID tag 370 of the light wand 250 is read internally, e.g., using the GPIO lines on the microprocessor 360, and the unique pen ID is used in the address field of the modified RC5 commands. The address is assigned and uploaded onto the light wand 250 via the RFID reader 170 (FIG. 1) for example. The uploading of the unique address may be performed, for example, by placing a light wand 250 on the RFID reader 170, either automatically or upon activation of a button of a user interface (UI) on the command converter 150 and/or of a UI of the system controller 160. The command converter 150 and/or the system controller 160 may be configured to store (in a memory operationally coupled to the command converter 150 and/or the system controller 160) a list of all registered the light wands and assign an available address, when a new the light wand is added.

Once light wands are registered with the lighting system, and/or unique addresses are uploaded to the light wands, then a user(s) may operate the lighting system anonymously using any one or multiple ones of the registered light pens simultaneously. In a more complex implementation, the lighting system maybe linked with a wider building management system in which the user(s) is identified and paired to a particular light wand. This may be achieved either through a UI local to the command converter 150 or system controller 160, or through a separate UI located in a remote location, e.g., in proximity to the RFID reader 170.

In a further embodiment, to help create a common look and feel throughout the various stores of a chain of shops, color swatches are provided having a coding scheme that may be used to replicate a desired color of shop lighting, for example. The coded color is then read by the light wand/pen 250, which is used to point to a light source(s)/panel(s) and recreate the desired color (read from a swatch book 390) on the light emanating from the light source(s)/panel(s).

Illustratively, a swatch book 390 may be provided that contains a set of colors and instructions about how certain elements should be used within a store to recreate a similar ambiance across each store. The swatch book may include descriptions about what colors should be used to highlight certain products, etc. A barcode or similar coded data may be included underneath the colors in the swatch book, where the barcode includes or represents information about the color settings of light source(s)/panel(s). In this embodiment, the light wand/pen 250 may also include a barcode reader 380, as shown by the dotted box in FIG. 3. The barcode reader 380 may be configured to read the color from the barcode, for example, and transmits it to a particular light source or panel, which then emits light having the color associated with the color code received from the light wand/pen 250 and read from the swatch book.

The light wand/pen 250 may have additional button for "copy" and "paste" or the existing buttons may be operated to perform copy and paste operations upon proper selection of the button mode, for example, by cycling through a mode select button. Alternatively, instead of the four buttons shown in FIG. 1, the light wand/pen 250 may have three buttons, namely, "copy," "paste" and "undo" buttons, or any combinations of buttons as desired.

The swatch book 390 includes a list of color charts of different colors representing each of the colors that should be used within the room, with a barcode 392 next to each color sample 394, for example. Illustratively, the color is encoded to represent an HSL (Hue, Saturation, Lightness) format such that it is independent of light rendering.

The barcodes 392 encode the color value for the associated color sample 394 to be used within the system. Of course, an instruction manual may also be provided to provide some explanatory text as to how the colors should be rendered within the room, particularly in the retail shop environment where a common look and feel is desired among the different stores of a chain store retailer for example. A barcode 392 may be read by the bar code reader 380 by activating the copy button or a further read/scan button, for example. Of course, the pen controller 360 is also operationally coupled to the barcode reader 380, buttons, and other elements of the light pen 250, such as a memory 385 for example.

The pen 250 may be activated by pressing the "copy" button. This starts the barcode reader 380 and the user points the pen 250 at a desired barcode 392 to render on or copy the light having the color associated with the desired barcode. Once a valid barcode is found, the code is read in and stored in memory of the pen 250. Upon completion of reading the desired barcode 392, the barcode scanner or reader 380 stops scanning and the user is informed via a feedback mechanism (e.g., an LED 345 flashing or ON, or a sound from a buzzer of the light pen 250 is provided) indicating that the pen 250 has successfully read the color. Optionally, if no color is read in after a period of time despite attempt to scan or read a barcode, then the user may be informed of the error.

To render the scanned or read color onto the light source(s)/panels(s), the user may press and hold the "paste" button and point the pen 250 at the desired light source/panel for updating or changing the color of light emanating therefrom. Illustratively, the paste button emits a series of IR commands and behaves in the following way shown in Table 6, which shows behavior of the buttons on the laser pen for example:

TABLE 6

| Condition | Action |
|---|---|
| On press and hold | Sends an IR message "Paste_Down", which repeats every 100 ms |
| On release | Sends an IR message "Paste_Up". This will discontinue any IR messages being sent from the key being pressed down and held |

Figure 10:
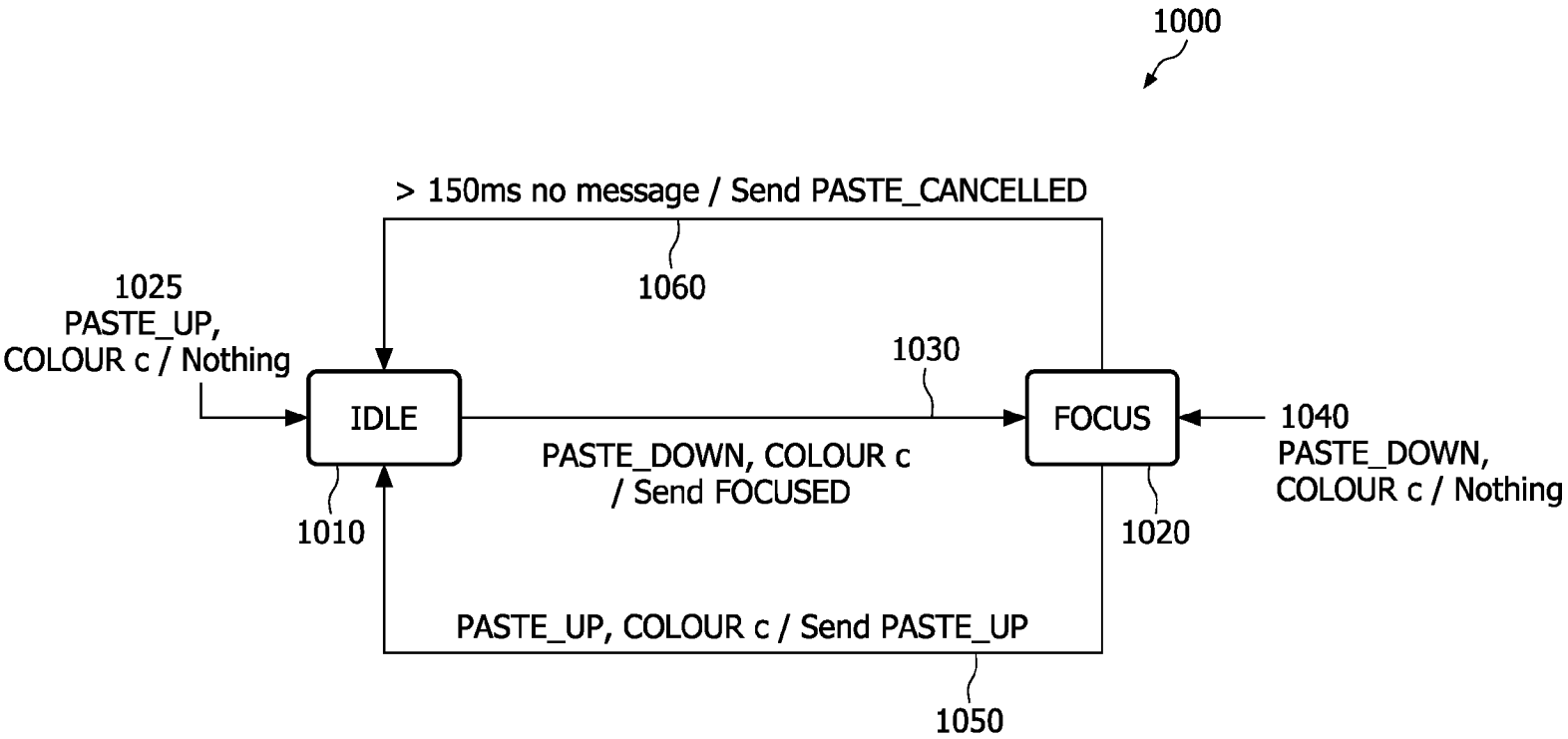
FIG. 10 shows an internal state machine of IR receivers according to a further illustrative embodiment of the present system.

FIG. 10 shows an internal state machine 1000 of the IR receivers, which is similar to the state machine 500 shown in FIG. 5. As shown in FIG. 10, the state machine 1000 includes an idle state 1010 and a focus or active state 1020. No change occurs and the idle state 1010 is maintained when no buttons of pressed on the light pen 250, as represented by the Paste_Up_No_change arrow 1025 in FIG. 10. When paste button of the light pen 250 is pressed the state is changed from the idle state 1010 to the active state 1020, as represented by the Paste_Down arrow 1030. No change occurs and the active state 1020 is maintained when the paste button is held-down, as represented by the Paste_Down_No_change arrow 1040. When the held-down paste button is released, the Paste_Up path 1050 is followed to go from the active state 1020 to the idle state 1010. If a Paste_Up command is not received within a predetermined time period, such as greater than 150 ms, indicating that the paste button is held-down or its release is not detected (such as when released while not pointing to any light source(s)/panel(s)), then cancel path 1060 is followed to change the state from the active state 1020 to the idle state 1010.

The command converter 150 may use internal queue as previously described to overcome any flickering as a consequence of two panels receiving the "Paste Down" message when the light wand 250 is dragging a light across the two panels.

At all times, it is the message at the head of the queue that is acted upon. Table 7 details how the different messages are responded to:

TABLE 7

| Key Parameter | Action |
|---|---|
| Paste Down, Color C from Light X | Change Light X to received color C |

Paste Cancelled and Paste Up commands, upon receipt are handled as shown in Table 8, for example:

TABLE 8

| Select Scroll Key Parameter | Action |
|---|---|
| Paste Up, Color C from Light X | Permanently store color C on Light X |
| Paste Cancelled from Light X | If Light X is the current focused light, then pop another message from the queue. Revert color of Light X to previous light |

Once a color is placed on a light, the command converter 150 then informs system controller 160 to update the light settings of the light, giving positive feedback to the user about where the color will be placed. Overall, the effect is that the user can read a color from the swatch book 390 and then move the color around the room (by controlling light source pointed at to emit light having the read color) until the user decides that the proper location of such a color. Once the desired color location is determined, the user may now paste the color on to the particular light(s)/panel(s) permanently, such as by releasing a held-down button, or activating another button, for example. The user may repeat this action, pasting the same color onto multiple lights in the same fashion, or read a different color and paste the different color in one or multiple locations.

As desired, the undo button may be activated to undo the last command, or commands by continuously pressing the undo button, i.e., to revert to the previous paste action, for example. Pressing the undo button once sends a single IR command to the IR receivers, which inform the command converter of the undo command. Again, filtering may be applied so that the undo command is only received once and by one receiver as desired.

It should be understood that details and components that are apparent to ones skilled in the art have not been described to maintain clarity and not obscure the description of the present system. For example, as it would be apparent to one skilled in the art of communication in view of the present description, various elements may be included in the system components for communication, such as transmitters, receivers, or transceivers, antennas, modulators, demodulators, converters, duplexers, filters, multiplexers etc. The communication or links among the various system components may be by any means, such as wired or wireless for example. The system elements may be separate or integrated together, such as with the processor.

As is well-known, the system and/or pen processors and/or controllers 160, 360 executes instruction stored in associated memories, such as the pen memory 385 and a further memory of the system 100 operationally coupled to the system controller 160, for example. The memories may also store other data, such as predetermined or programmable settings related to system interaction, thresholds, setting for the screens projected on the shop window.

It should be understood that the various component of the interaction system may be operationally coupled to each other by any type of link, including wired or wireless link(s), for example. Various modifications may also be provided as recognized by those skilled in the art in view of the description herein. The memory may be any type of device for storing application data as well as other data. The application data and other data are received by the controller or processor for configuring it to perform operation acts in accordance with the present systems and methods.

The operation acts of the present methods are particularly suited to be carried out by a computer software program, such computer software program preferably containing modules corresponding to the individual steps or acts of the methods. Such software can of course be embodied in a computer-readable medium, such as an integrated chip, a peripheral device or memory, such as the memory or other memory coupled to the processor of the controller or light module.

The computer-readable medium and/or memory may be any recordable medium (e.g., RAM, ROM, removable memory, CD-ROM, hard drives, DVD, floppy disks or memory cards) or may be a transmission medium (e.g., a network comprising fiber-optics, the world-wide web, cables, and/or a wireless channel using, for example, time-division multiple access, code-division multiple access, or other wireless communication systems). Any medium known or developed that can store information suitable for use with a computer system may be used as the computer-readable medium and/or pen and system memories.

Additional memories may also be used. The computer-readable medium, the memories, and/or any other memories may be long-term, short-term, or a combination of long-and-short term memories. These memories configure the system and/or pen controllers 160, 360 to implement the methods, operational acts, and functions disclosed herein. The memories may be distributed or local and the processor, where additional processors may be provided, may be distributed or singular. The memories may be implemented as electrical, magnetic or optical memory, or any combination of these or other types of storage devices. Moreover, the term "memory" should be construed broadly enough to encompass any information able to be read from or written to an address in the addressable space accessed by a processor. With this definition, information on a network is still within memory, for instance, because the processor may retrieve the information from the network.

The system and/or pen processors 160, 360 and the memories may be any type of processor/controller and memory, such as those described in U.S. 2003/0057887, which is incorporated herein by reference in its entirety. The processor may be capable of performing operations in response to detecting user's gazes, and executing instructions stored in the memory. The processor may be an application-specific or general-use integrated circuit(s). Further, the processor may be a dedicated processor for performing in accordance with the present system or may be a general-purpose processor wherein only one of many functions operates for performing in accordance with the present system. The processor may operate utilizing a program portion, multiple program segments, or may be a hardware device utilizing a dedicated or multi-purpose integrated circuit. Each of the above systems utilized for controlling light sources as described.

Of course, it is to be appreciated that any one of the above embodiments or processes may be combined with one or with one or more other embodiments or processes to provide even further improvements in controlling the light sources.

Finally, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the broader and intended spirit and scope of the present system as set forth in the claims that follow. The specification and drawings are accordingly to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same or different item(s) or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise; and h) no specific sequence of acts or steps is intended to be required unless specifically indicated.

The invention claimed is:

1. A lighting system comprising:

a plurality of light sources;

a remote controller configured to control said plurality of light sources in response to user input, wherein said remote controller is configured to copy a light attribute of a first light provided from a first light source of said plurality of light sources, and paste said light attribute into a second light source of said plurality of light sources so that said second light source provides a second light having said light attribute of said first light;

a system controller configured to accept signals substantially simultaneously from said remote controller; and a further remote controller to substantially simultaneously control one light source pointed to by said remote controller and another light source pointed to by said further remote controller.

2. The lighting system of claim 1, wherein said remote controller comprises a key that copies said attribute when activated while pointing to said first light source, said attribute being draggable to said second light source by pointing said remote controller to said second light source, said light attribute being pasted to said second light source upon deactivating said key.

3. The lighting system of claim 1, wherein said remote controller further comprises an undo key configured to undo a last action when activated.

4. The lighting system of claim 1, wherein said remote controller further comprises a change key configured to change said light attribute.

5. The lighting system of claim 1, wherein said remote controller further comprises a tag including a unique identification for identifying said remote controller.

6. The lighting system of claim 5, wherein said system controller is configured to accept signals substantially simultaneously from said remote controller and said further remote controller; said signals including identifying information of said remote controller.

7. The lighting system of claim 1, wherein said remote controller further comprises a reader configured to read data relate to a color, and control one of said plurality of light sources to provide light having said color.

8. A method of controlling a plurality of light sources comprising the acts of:

copying a light attribute of a first light provided from a first light source of said plurality of light sources; and pasting said light attribute into a second light source of said plurality of light sources so that said second light source provides a second light having said light attribute of said first light, wherein the copying and pasting acts comprise:

activating a key of a remote controller while pointing it to said first light source;

dragging said attribute to said second light source by pointing said remote controller to said second light source while said key is activated; and deactivating said key while said remote controller is pointed to said second light source to paste said light attribute to said second light source.

9. The method of claim 8, further comprising the act of transmitting identifying information of said remote controller to a system controller.

10. The method of claim 8, further comprising the act of substantially simultaneously controlling said first light source pointed to by a first remote controller and said second light source pointed to by a further remote controller.

11. The method of claim 8, further comprising the acts of:

reading data relate to a color; and controlling said first light source to provide light having said color.

12. A light wand comprising a controller configured to control a plurality of light sources in response to user input, wherein said controller is configured to copy a light attribute of a first light provided from a first light source of said plurality of light sources, and paste said light attribute into a second light source of said plurality of light sources so that said second light source provides a second light having said light attribute of said first light; and a key that copies said attribute when activated while said light wand (250) is pointed to said first light source, said attribute being draggable to said second light source by pointing said light wand to said second light source, said light attribute being pasted to said second light source upon deactivating said key.

13. The light wand of claim 12, further comprising a tag including a unique identification for identifying said remote controller.

14. The light wand of claim 12, further comprising a reader configured to read data relate to a color, and control one of said plurality of light sources to provide light having said color.

15. A lighting system comprising:

a plurality of light sources; and directional control means configured to control said plurality of light sources in response to user input while pointed to one of said plurality of light sources, wherein said directional control means is configured to drag a light provided from a first light source of said plurality of light sources to a second light source of said plurality of light sources by being pointed and moved from said first light source to said second light source.

16. The lighting system of claim 15, wherein said directional control means is configured to paint an image using said plurality of light sources by at least one of drag, copy and paste operations.

* * * * *